US010388428B2

(12) United States Patent
Nakashima et al.

(10) Patent No.: US 10,388,428 B2
(45) Date of Patent: Aug. 20, 2019

(54) ELECTRIC WIRE WITH CONNECTOR, AND WIRE HARNESS

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Kazuo Nakashima, Mie (JP); Katsufumi Matsui, Mie (JP); Takaaki Hamaguchi, Mie (JP); Koki Murata, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 15/748,777

(22) PCT Filed: Jul. 20, 2016

(86) PCT No.: PCT/JP2016/071297
§ 371 (c)(1),
(2) Date: Jan. 30, 2018

(87) PCT Pub. No.: WO2017/022489
PCT Pub. Date: Feb. 9, 2017

(65) Prior Publication Data

US 2019/0013113 A1 Jan. 10, 2019

(30) Foreign Application Priority Data

Aug. 6, 2015 (JP) ..... 2015-156184

(51) Int. Cl.
*H01B 3/42* (2006.01)
*H01B 3/46* (2006.01)
(Continued)

(52) U.S. Cl.
CPC ..... *H01B 7/282* (2013.01); *H01B 3/42* (2013.01); *H01B 3/46* (2013.01); *H01B 7/00* (2013.01);
(Continued)

(58) Field of Classification Search
CPC ... H01B 3/42; H01B 3/46; H01B 7/00; H01B 7/0045; H01B 7/282; H01R 4/18;
(Continued)

(56) References Cited

U.S. PATENT DOCUMENTS 4,986,764 A * 1/1991 Eaby ..... H01R 13/53 439/275
6,176,831 B1 * 1/2001 Voss ..... A61B 5/022 600/485
2018/0054019 A1 * 2/2018 Itani ..... H01R 43/005

FOREIGN PATENT DOCUMENTS

JP S60105078 U 7/1985
JP 2014164952 A 9/2014

OTHER PUBLICATIONS

International Search Report for Application No. PCT/JP2016/071297 dated Oct. 11, 2016; 5 pages.
(Continued)

*Primary Examiner* — Timothy J Thompson
*Assistant Examiner* — Guillermo J Egoavil
(74) *Attorney, Agent, or Firm* — Reising Ethington, P.C.

(57) ABSTRACT

An electric wire with a connector in which high adhesiveness can be ensured at both the interface between an insulator and a sealing layer and the interface between a connector housing and the sealing layer, and a wire harness
(Continued)

using this electric wire with a connector are provided. The electric wire with a connector includes an insulated electric wire including a conductor and an insulator containing silicone with which the outer circumference of the conductor is coated, a connector terminal connected to a portion of the conductor exposed by stripping a portion of the insulator, a connector housing made of a resin in which an end of the insulated electric wire and a portion of the connector terminal are embedded, and a sealing layer provided between the surface of the insulator and the connector housing covering the outer circumference of the surface of the insulator at the end of the insulated electric wire. The sealing layer is constituted by a sticky adhesive.

6 Claims, 1 Drawing Sheet

(51) Int. Cl.
*H01B 7/00* (2006.01)
*H01B 7/282* (2006.01)
*H01R 13/52* (2006.01)
*H01R 43/24* (2006.01)

(52) U.S. Cl.
CPC ..... *H01B 7/0045* (2013.01); *H01R 13/5205* (2013.01); *H01R 13/5216* (2013.01); *H01R 43/24* (2013.01)

(58) Field of Classification Search
CPC ..... H01R 4/62; H01R 13/52; H01R 13/53; H01R 13/5205; H01R 13/5216; H01R 43/24
USPC ..... 174/72 A; 439/275
See application file for complete search history.

(56) References Cited

OTHER PUBLICATIONS

International Preliminary Report on Patentability for Application No. PCT/2016/071297 dated Feb. 16, 2017; 6 pages.

* cited by examiner

ELECTRIC WIRE WITH CONNECTOR, AND WIRE HARNESS

CROSS REFERENCE TO RELATED APPLICATIONS

This application claims the priority of Japanese patent application JP2015-156184 filed on Aug. 6, 2015, the entire contents of which are incorporated herein.

TECHNICAL FIELD

The present invention relates to an electric wire with a connector, and a wire harness.

BACKGROUND ART

Conventionally, wire harnesses called "AC harnesses" have been used to connect inverters and motors, for example, in hybrid cars, electric cars, and the like. An electric wire with a connector, in which a connector is attached to an end of an insulated electric wire including an insulator made of silicone having a high heat resistance, is used in this type of wire harness. In general, in such an electric wire with a connector, the end of the insulated electric wire is embedded in a connector housing included in the connector by insert molding. A sealing layer constituted by an adhesive is provided between the surface of the insulator and the connector housing covering the outer circumference of the insulator at the end of the insulated electric wire in order to improve the water-blocking ability (see Patent Document 1 (JP 2009-252712A), for example).

SUMMARY

However, silicone has poor adhesiveness. Therefore, it is difficult to sufficiently adhere the insulator made of silicone and the connector housing to each other using common adhesives that are adaptable to insert molding. For this reason, adhesive strength is insufficient at the interface between the insulator and the sealing layer and the interface between the connector housing and the sealing layer, and separation is thus likely to occur at these interfaces. When separation occurs at the interface, water is likely to move along the interface and infiltrate the connector housing, and the water-blocking ability thus deteriorates.

The present design was achieved in view of the above-described background, and provides an electric wire with a connector in which high adhesiveness can be ensured at both the interface between the insulator and the sealing layer and the interface between the connector housing and the sealing layer, and a wire harness using this electric wire with a connector.

An aspect of the present design is an electric wire with a connector, including an insulated electric wire including a conductor and an insulator containing silicone with which an outer circumference of the conductor is coated, a connector terminal connected to a portion of the conductor exposed by stripping a portion of the insulator, a connector housing made of a resin in which an end of the insulated electric wire and a portion of the connector terminal are embedded, and a sealing layer provided between a surface of the insulator and the connector housing covering an outer circumference of the surface of the insulator at the end of the insulated electric wire, wherein the sealing layer is constituted by a sticky adhesive.

Another aspect of the present design is a wire harness including the above-mentioned electric wire with a connector.

In the above-mentioned electric wire with a connector, the sealing layer is constituted by a sticky adhesive. Therefore, high adhesiveness can be ensured at both the interface between the insulator containing poorly adhesive silicone and the sealing layer and the interface between the connector housing and the sealing layer.

The above-mentioned wire harness includes the above-mentioned electric wire with a connector. Therefore, the wire harness is provided with an excellent water-blocking ability.

DESCRIPTION OF EMBODIMENTS

Figure 1:
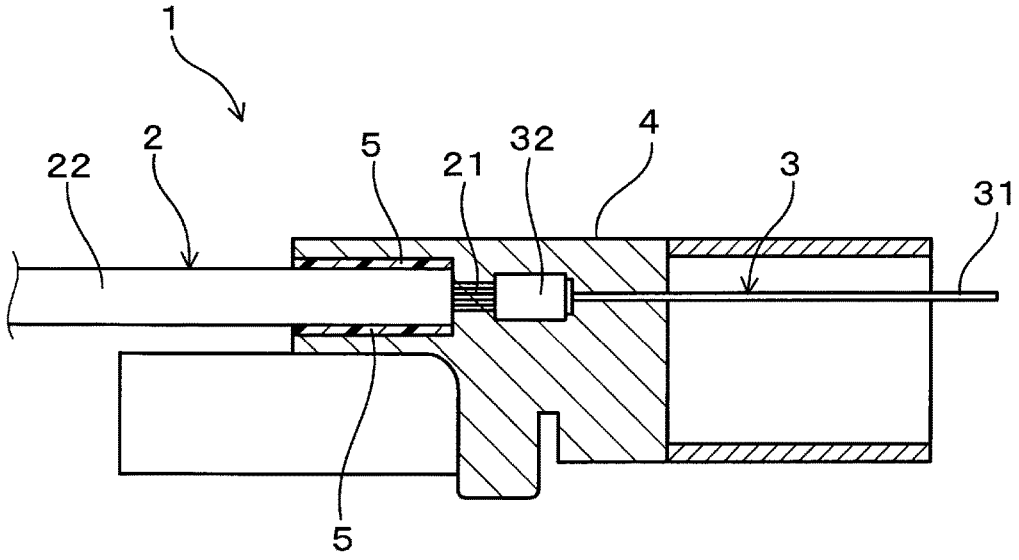
FIG. 1 is a schematic view of an electric wire with a connector of Example 1.

In the above-mentioned electric wire with a connector, the sealing layer is constituted by a sticky adhesive. The surface of the sticky adhesive is sticky at ordinary temperature. Any adhesive can be used in the electric wire with a connector as long as the adhesive is sticky.

Examples of the sticky adhesive include thermoplastic resin-based sticky adhesives and thermosetting resin-based sticky adhesives. More specifically, a silicone-based sticky adhesive can be favorably used as the sticky adhesive, for example. A silicone-based non-sticky adhesive needs to be cured by moisture or heat after being applied to the surface of the insulator so as not to come off during insert molding due to the resin material used in the connector housing. The silicone-based adhesive cured in this manner is insufficiently adhered to a resin used in insert molding. In contrast, the silicone-based sticky adhesive can be stably adhered to both an insulator containing silicone and a resin used in insert molding. A possible reason for this is that the adhesive soaks into the insulator and is then cured due to good compatibility with silicone contained in the insulator, or the adhesive comes into contact with the resin used in insert molding due to the stickiness of the adhesive. Therefore, when the silicone-based sticky adhesive is used as the sticky adhesive, high adhesiveness is likely to be ensured at both the interface between the insulator and the sealing layer and the interface between the connector housing and the sealing layer. Specific examples of the silicone-based sticky adhesive include SD4580 manufactured by Dow Corning Toray Co., Ltd., and a mixture obtained by mixing a platinum catalyst in SD4580.

In addition, a synthetic rubber-based sticky adhesive can also be favorably used as the sticky adhesive, for example. When a synthetic rubber-based non-sticky adhesive is used, it may be necessary to perform pretreatment such as plasma treatment or primer treatment on the surface of the insulator containing silicone before applying the adhesive thereto. Therefore, a lot of troublesome tasks and a long period of time are required. In contrast, when the synthetic rubber-based sticky adhesive is used, high adhesiveness can be ensured at both the interface between the insulator and the sealing layer and the interface between the connector housing and the sealing layer without performing such pretreatment. Specific examples of the synthetic rubber-based sticky adhesive include Hamatite M6280 (butyl rubber-based sticky adhesive) manufactured by Yokohama Rubber Co., Ltd., and Hirodine No. 5132 manufactured by Yasuhara Chemical Co., Ltd. It should be noted that a solvent-type sticky adhesive, a hot melt-type sticky adhesive, and the like can be used.

In the above-mentioned electric wire with a connector, the thickness of the sealing layer can be preferably set to be within a range of 1 to 150 more preferably 5 to 100 and even more preferably 10 to 50 μm from the viewpoint of ensuring the adhesiveness, improving the water-blocking ability, and the like. It is preferable that the length of the sealing layer in the axial direction of the electric wire is as long as possible from the viewpoint of ensuring the adhesiveness, improving the water-blocking ability, and the like. However, the length of the sealing layer in the axial direction of the electric wire can be preferably set to be within a range of 1 to 15 mm from the viewpoint of reducing the size of the connector.

In the above-mentioned electric wire with a connector, a polyester-based resin, a polyamide-based resin, or the like can be preferably used as a resin for forming the connector housing from the viewpoint of heat resistance and the like. Examples of the polyester-based resin include polybutylene terephthalate and polyethylene terephthalate. An example of the polyamide-based resin is polyphthalamide. It should be noted that the resin for forming the connector housing can contain various additives that are commonly used in connector housings.

In the above-mentioned electric wire with a connector, the silicone contained in the insulator of the insulated electric wire is preferably crosslinked silicone rubber (rubber also encompasses elastomer; this statement will be omitted hereinafter) from the viewpoint that it is advantageous for improving the heat resistance, and the like. It should be noted that the insulator can contain, in addition to the silicone, various additives such as an inorganic filler, a crosslinking agent, a crosslinking aid, a pigment, and a dye that are commonly used in insulators of insulated electric wires.

The above-mentioned wire harness includes the above-mentioned electric wire with a connector. The wire harness may include one or more electric wires with a connector.

It should be noted that the above-described configurations can be used in combination as desired in order to obtain the above-described functions and effects.

Example 1

An electric wire with a connector of Example 1 will be described with reference to FIG. 1. As shown in FIG. 1, an electric wire 1 with a connector of this example includes an insulated electric wire 2, a connector terminal 3, a connector housing 4, and a sealing layer 5.

The insulated electric wire 2 includes a conductor 21, and an insulator 22 with which the outer circumference of the conductor 21 is coated. In this example, the conductor 21 is made of copper or a copper alloy. The conductor 21 may also be made of aluminum, an aluminum alloy, or the like. The insulator 22 contains silicone. Specifically, in this example, crosslinked silicone rubber is used as the silicone. More specifically, the insulator 22 is formed by crosslinking a silicone rubber composition containing uncrosslinked silicone rubber, a crosslinking agent, an inorganic filler, and the like.

The connector terminal 3 is connected to a portion of the conductor 21 exposed by stripping the insulator 22 at an end of the insulated electric wire 2. FIG. 1 shows an example in which the connector terminal 3 has a male terminal shape. The connector terminal 3 includes a tab-shaped fitted portion 31 to be fitted into a female terminal, and a crimped portion 32 to be crimped and fixed to the conductor 21 through pressure bonding.

The connector housing 4 is made of a resin. Specifically, in this example, the connector housing 4 is made of polybutylene terephthalate, which is a polyester-based resin. The connector housing 4 can also be made of polyphthalamide, which is a polyamide-based resin. The end of the insulated electric wire 2 and a portion of the connector terminal 3 are embedded in the connector housing 4. Specifically, in this example, a portion of the insulator 22 located on the rear side of the exposed portion of the conductor 21, the exposed portion of the conductor 21, and the crimped portion 32 of the connector terminal 3 are embedded in the connector housing 4.

The sealing layer 5 is provided between the surface of the insulator 22 and the connector housing 4 covering the outer circumference of the surface of the insulator 22 at the end of the insulated electric wire 2. The sealing layer 5 is constituted by a sticky adhesive. In this example, a silicone-based sticky adhesive is used as the sticky adhesive. A synthetic rubber-based sticky adhesive can also be used as the sticky adhesive. It should be noted that, in this example, the sealing layer has a thickness of 10 μm. Moreover, the sealing layer 5 has a length of 2.5 mm in the axial direction of the electric wire.

The electric wire 1 with a connector of this example can be manufactured as follows, for example.

First, a portion of the conductor 21 is exposed by stripping the insulator 22 at the end of the prepared insulated electric wire 2. Next, the connector terminal 3 is crimped to the exposed portion of the conductor 21. Then, the sticky adhesive is applied to a predetermined range on the surface of the insulator 22 at the end of the insulated electric wire 2. At this time, when a solvent-type sticky adhesive is used as the sticky adhesive, it is sufficient that the adhesive is applied to the surface of the insulator 22 and then evaporated. When a hot melt-type sticky adhesive is used as the sticky adhesive, it is sufficient that the adhesive is softened to be suitable for application and then applied to the surface of the insulator 22 and cooled. Next, the connector housing 4 is formed by insert molding. Specifically, the insulated electric wire 2 to which the sticky adhesive has been applied is arranged at a predetermined position in a metal mold for forming the connector housing 4, and then a resin material that has been heated and melted is poured into the mold and molded. Then, the molded product is cooled and then removed from the mold. As a result, the end of the insulated electric wire 2 and a portion of the connector terminal 3 are embedded in the connector housing 4, and the sealing layer 5 is formed between the surface of the insulator 22 and the connector housing 4 covering the outer circumference of the insulator 22 at the end of the insulated electric wire 2. The electric wire 1 with a connector of this example is thus obtained.

In the electric wire 1 with a connector of this example, the sealing layer 5 is constituted by the sticky adhesive. Therefore, high adhesiveness can be ensured at both the interface between the insulator 22 containing poorly adhesive silicone and the sealing layer 5 and the interface between the connector housing 4 and the sealing layer 5.

Example 2

A wire harness of Example 2 will be described. The wire harness of this example (not shown) includes the electric wire 1 with a connector of Example 1. Specifically, in this example, the wire harness includes an electric wire bundle (not shown) obtained by bundling a plurality of electric wires 1 with connectors of Example 1. Moreover, a harness protective material (not shown) is provided around the outer circumference of the electric wire bundle.

The wire harness of this example includes the electric wires 1 with connectors of Example 1, and is thus provided with an excellent water-blocking ability.

EXPERIMENTAL EXAMPLES

Hereinafter, specific description will be given by way of experimental examples.

Preparation of Materials

The following materials were prepared.

Silicone rubber plate (manufactured by Kurabe Industrial Co., Ltd.; size: 40 mm long×19.5 mm wide×1.6 mm thick)

It should be noted that the silicone rubber plate simulated the insulator of the insulated electric wire.

PBT (polybutylene terephthalate) ("5101G-30U" manufactured by Toray Industries Inc.)

PA6T (polyphthalamide resin) ("Zytel HTNFR52G30NHF" manufactured by DuPont)

It should be noted that PBT and PA6T were used as resins for insert molding.

Adhesive A (silicone-based sticky adhesive) (mixture of "SD4580" manufactured by Dow Corning Toray Co., Ltd. and a platinum catalyst ("NC-25 CATALYST" manufactured by Dow Corning Toray Co., Ltd.)

Adhesive B (synthetic rubber-based sticky adhesive (butyl rubber-based adhesive)) ("Hamatite M6280" manufactured by Yokohama Rubber Co., Ltd.)

Adhesive C (synthetic rubber-based sticky adhesive) ("Hirodine No. 5132" manufactured by Yasuhara Chemical Co., Ltd.)

Adhesive D (silicone-based non-sticky adhesive ("TSE3975" manufactured by Momentive Performance Materials Inc.)

Adhesive E (synthetic rubber-based non-sticky adhesive (butyl rubber-based adhesive)) ("Hamatite M155" manufactured by Yokohama Rubber Co., Ltd.)

It should be noted that Adhesives A to E were used to form sealing layers. Adhesive A is a solvent-type adhesive diluted by toluene. Adhesives B, C and E are hot melt-type adhesives. Adhesive D is a moisture curing-type adhesive.

Production of Samples

Sample 1

Adhesive A was applied to the surface of the silicone rubber plate and then evaporated at room temperature for 12 hours, followed by insert molding (resin temperature was set to 250° C.) using PBT as a molding resin. Sample 1 was thus produced.

Sample 2

Adhesive B, which had been softened at 200° C., was applied to the surface of the silicone rubber plate and then cooled at room temperature for 1 hour, followed by insert molding (resin temperature was set to 250° C.) using PBT as a molding resin. Sample 2 was thus produced.

Sample 3

Adhesive A was applied to the surface of the silicone rubber plate and then evaporated at room temperature for 12 hours, followed by insert molding (resin temperature was set to 325° C.) using PA6T as a molding resin. Sample 3 was thus produced.

Sample 4

Adhesive B, which had been softened at 200° C., was applied to the surface of the silicone rubber plate and then cooled at room temperature for 1 hour, followed by insert molding (resin temperature was set to 325° C.) using PA6T as a molding resin. Sample 4 was thus produced.

Sample 5

Adhesive C, which had been softened at 200° C., was applied to the surface of the silicone rubber plate and then cooled at room temperature for 1 hour, followed by insert molding (resin temperature was set to 250° C.) using PBT as a molding resin. Sample 5 was thus produced.

Sample 1C

Adhesive D was applied to the surface of the silicone rubber plate and then cured at room temperature for 24 hours, followed by insert molding (resin temperature was set to 250° C.) using PBT as a molding resin. Sample 1C was thus produced.

Sample 2C

Adhesive D was applied to the surface of the silicone rubber plate and then cured at room temperature for 24 hours, followed by insert molding (resin temperature was set to 325° C.) using PA6T as a molding resin. Sample 2C was thus produced.

Sample 3C

Adhesive E, which had been softened at 200° C., was applied to the surface of the silicone rubber plate and then cooled at room temperature for 1 hour, followed by insert molding (resin temperature was set to 250° C.) using PBT as a molding resin. Sample 3C was thus produced.

Sample 4C

Adhesive E, which had been softened at 200° C., was applied to the surface of the silicone rubber plate and then cooled at room temperature for 1 hour, followed by insert molding (resin temperature was set to 325° C.) using PA6T as a molding resin. Sample 4C was thus produced.

It should be noted that, in each of the samples, a molded resin product obtained through insert molding simulated a connector housing, and had a size of 30 mm long×10 mm wide×2 mm thick. A portion of the molded resin product that overlapped the silicone rubber plate had a length of 20 mm.

Evaluation Test

Tensile Shear Adhesive Strength Test

The tensile shear adhesive strength of each of the produced samples was measured in conformity with JIS S6040. The fracture form of the fracture surface in the sample was observed after the tensile shear adhesive strength test. Interfacial fracture occurring in the sealing layer makes it likely that water will infiltrate the connector housing through the interface, and the water-blocking ability thus deteriorates. Therefore, it is important that the fracture form of the fractured sealing is not interfacial fracture but material fracture.

Probe Tack Test

The probe tack test was performed in conformity with ASTM D2979. Specifically, a predetermined adhesive was applied onto a PET film to form an adhesive layer with a thickness of 20 μm, and a test piece shaped to a size of 2 cm×2 cm was then prepared. Next, the test piece was brought into contact with and adhered to the end surface of a columnar probe with a diameter φ of 5 mm at 23° C. (ordinary temperature) at a speed of 5 cm/sec with a load of 10 g being applied to this test piece in an orientation in which the adhesive layer was located on the lower side. Thereafter, the probe was pulled up at a speed of 5 cm/sec, and the peel strength was measured. It should be noted that this probe tack test was performed to quantitatively evaluate the stickiness of the adhesive. In this specification, when the peel strength was less than or equal to 1 N/5 mm φ, the adhesive was evaluated as having no stickiness.

Water-Blocking Confirmation Test

At the end of an insulated electric wire including an insulator made of silicone, a portion of the insulator was stripped, and a connector terminal made of metal was crimped. After the above-described predetermined adhesive was applied to the surface of the insulator at the end of this electric wire, the electric wire was placed in a metal mold, and then insert molding using the above-described predetermined molding resin was performed. Evaluation samples having a configuration as described below were formed, and then the water-blocking confirmation test was performed.

Figure 2:
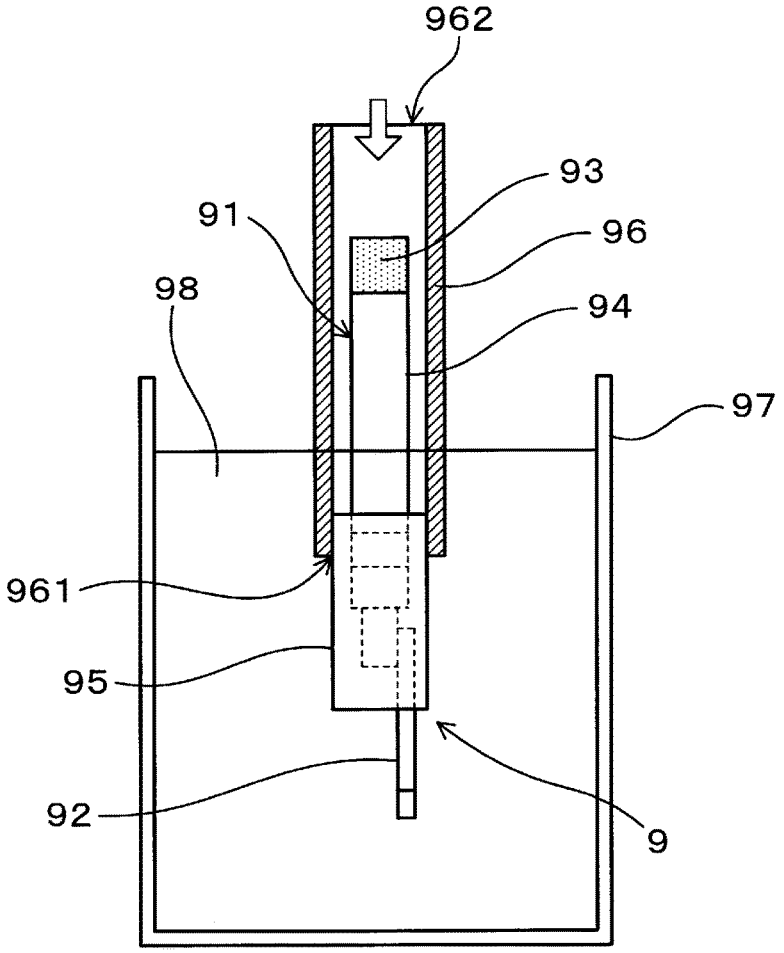
FIG. 2 is an explanatory diagram illustrating a water-blocking confirmation test in experimental examples.

Specifically, as shown in FIG. 2, in an evaluation sample 9, an end of an insulated electric wire 91 on a side opposite to the end connected to a connector terminal 92 is sealed with a blocking material 93 such as a heat shrinkable tube such that air is prevented from entering the inside of the insulator 94. Moreover, a portion in the evaluation sample 9 between a portion of a molded resin product 95 and the end of the insulated electric wire 91 sealed with the blocking material 93 is held in a state in which it is inserted into a cylindrical member 96. One opening 961 of the cylindrical member 96 in the evaluation sample 9 is tightly closed by the molded resin product 95. In the water-blocking confirmation test, a region in the evaluation sample 9 between the connector terminal 92 at the leading end and a portion of the insulated electric wire 91 surrounded by the cylindrical member 96 is immersed in water 98 stored in a tank 97. Furthermore, in the water-blocking confirmation test, compressed air with a maximum pressure of 150 kPa is supplied from the other opening 962 of the cylindrical member 96. In the configuration described above, it was confirmed whether or not air bubbles are produced from a gap between the molded resin product 95 and the connector terminal 92 in the evaluation sample 9. When no air bubbles were produced, the water-blocking ability was evaluated as being acceptable, and when air bubbles were produced, the water-blocking ability was evaluated as being not acceptable.

Table 1 shows the specific configurations of the samples and the evaluation results.

TABLE 1

| | Samples | | | | | | | | |
|---|---|---|---|---|---|---|---|---|---|
| | 1 | 2 | 3 | 4 | 5 | 1C | 2C | 3C | 4C |
| Type of adhesive used (Sticky adhesive) | A (Yes) | B (Yes) | A (Yes) | B (Yes) | C (Yes) | D (No) | D (No) | E (No) | E (No) |
| Molding resin | PBT | PBT | PA6T | PA6T | PBT | PBT | PA6T | PBT | PA6T |
| Tensile shear adhesive strength (kPa) | 845 | 154 | 840 | 148 | 155 | 590 | 740 | 144 | 138 |
| Fracture form | Material fracture | Material fracture | Material fracture | Material fracture | Material fracture | PBT interface | PA6T interface | Silicone interface | Silicone interface |
| Peel strength (N/5 mmφ) | 8.2 | 3.0 | 7.9 | 2.8 | 2.9 | 0.1 | 0.1 | 0.2 | 0.3 |
| Water-blocking ability | Acceptable | Acceptable | Acceptable | Acceptable | Acceptable | Not acceptable | Not acceptable | Not acceptable | Not acceptable |

A silicone-based non-sticky adhesive was used in Samples 1C and 2C. Therefore, Samples 1C and 2C were adhered to silicone, but poorly adhered to the insert molding resin, and interfacial fracture occurred on the insert molding resin side. Moreover, air-bubbles were observed when the water-blocking ability was evaluated.

A synthetic rubber-based non-sticky adhesive was used in Samples 3C and 4C. Therefore, Samples 3C and 4C were poorly adhered to silicone, and interfacial fracture occurred on the silicone side. Moreover, air-bubbles were observed when the water-blocking ability was evaluated.

In contrast, a silicone-based sticky adhesive or a synthetic rubber-based sticky adhesive was used in Samples 1 to 5. Therefore, interfacial fracture did not occur, but material fracture occurred in the sealing layers, thus making it possible to ensure high adhesiveness. Moreover, no air-bubbles were observed when the water-blocking ability was evaluated.

Although examples and experimental examples of the present invention have been described in detail, the present invention is not limited to the above examples and experimental examples, and it will be appreciated that various modifications can be made without impairing the gist of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An electric wire with a connector, comprising:

an insulated electric wire including a conductor and an insulator containing silicone with which an outer circumference of the conductor is coated;

a connector terminal including a crimped portion and a fitting portion, the crimped portion is connected to a portion of the conductor exposed by stripping a portion of the insulator, and the fitting portion has either a male terminal shape or a female terminal shape;

a connector housing made of a resin, the connector housing is molded around and contacts the exposed portion of the conductor and the crimped portion of the connector terminal such that the connector terminal is at least partially embedded in the connector housing and the connector housing prevents the connector terminal from being removed; and a sealing layer provided between a surface of the insulator and the connector housing covering an outer circumference of the surface of the insulator at an end of the insulated electric wire, wherein the sealing layer is constituted by a sticky adhesive.

2. The electric wire with a connector according to claim 1, wherein the sealing layer is adhered to both the insulator and the connector housing.

3. The electric wire with a connector according to claim 1, wherein one of a silicone-based sticky adhesive and a synthetic rubber-based sticky adhesive is used as the sticky adhesive.

4. The electric wire with a connector according to claim 1, wherein one of a polyester-based resin and a polyamide-based resin is used as a resin for forming the connector housing.

5. A wire harness comprising the electric wire with a connector according to claim 1.

6. The electric wire with a connector according to claim 1, wherein the connector housing is formed by insert molding around the outer circumference of the surface of the insulator at the end of the insulated electric wire on which the sealing layer is provided.

* * * * *